US008235579B2

(12) United States Patent
Hielscher et al.

(10) Patent No.: US 8,235,579 B2
(45) Date of Patent: Aug. 7, 2012

(54) DEVICE FOR INTRODUCING ULTRASOUND INTO A FLOWABLE MEDIUM

(75) Inventors: Harald Hielscher, Stahnsdorf (DE); Holger Hielscher, Teltow (DE); Thomas Hielscher, Stahnsdorf (DE)

(73) Assignee: Dr. Hielscher GmbH, Teltow (DE)

( * ) Notice: Subject to any disclaimer, the term of this patent is extended or adjusted under 35 U.S.C. 154(b) by 773 days.

(21) Appl. No.: 11/569,398

(22) PCT Filed: May 12, 2005

(86) PCT No.: PCT/EP2005/005324

§ 371 (c)(1), (2), (4) Date: Nov. 13, 2007

(87) PCT Pub. No.: WO2005/115602

PCT Pub. Date: Dec. 8, 2005

(65) Prior Publication Data

US 2008/0192568 A1 Aug. 14, 2008

(30) Foreign Application Priority Data

May 24, 2004 (DE) ..... 10 2004 025 836

(51) Int. Cl.
*B01F 11/00* (2006.01)

(52) U.S. Cl. ..... 366/118; 366/127

(58) Field of Classification Search ..... 241/2; 366/118, 366/127; 435/259

See application file for complete search history.

(56) References Cited

U.S. PATENT DOCUMENTS 2,138,052 A * 11/1938 Williams ..... 366/118
2,387,845 A * 10/1945 Harry ..... 381/113
2,468,538 A * 4/1949 Benioff ..... 366/113
2,693,944 A * 11/1954 Fowle ..... 366/116
2,930,913 A * 3/1960 Camp et al. ..... 310/26
2,956,538 A * 10/1960 Rich ..... 116/137 A
2,995,347 A * 8/1961 Rich ..... 366/115
3,007,814 A * 11/1961 Bulat ..... 588/9
3,058,014 A * 10/1962 Camp ..... 310/325
3,084,020 A * 4/1963 Loosli ..... 8/130.1
3,113,225 A * 12/1963 Kleesattel et al. ..... 310/26
3,145,312 A * 8/1964 McAuley ..... 310/26
3,198,971 A * 8/1965 McAuley et al. ..... 310/26
3,301,535 A * 1/1967 Brown ..... 366/113
3,321,189 A * 5/1967 Scarpa ..... 366/127
3,345,927 A * 10/1967 Takats ..... 134/64 R
3,481,687 A * 12/1969 Fishman ..... 422/20
3,581,125 A * 5/1971 Arndt et al. ..... 310/316.01
3,600,614 A * 8/1971 Curtis ..... 310/25

(Continued)

FOREIGN PATENT DOCUMENTS

CA 850599 A * 9/1970

(Continued)

*Primary Examiner* — David Sorkin

(74) *Attorney, Agent, or Firm* — Norris McLaughlin & Marcus P.A.

(57) ABSTRACT

The invention relates to a method and a device for introducing ultrasound into a flowable medium using a sonotrode, wherein the flowable medium is not in direct contact with the sonotrode. Disclosed is a method comprising the following steps: placing a film (8) on the sonotrode (4) in such a way that the contact force by means of which the film (8) is pressed on the sonotrode (4) is always so great that the film (8) follows the lifting motions of the sonotrode (4) in the corresponding frequency and amplitude; applying ultrasound power through the film (8) into the medium (2) and transmitting the wear phenomena onto the film (8).

6 Claims, 5 Drawing Sheets

U.S. PATENT DOCUMENTS

Figure 1:
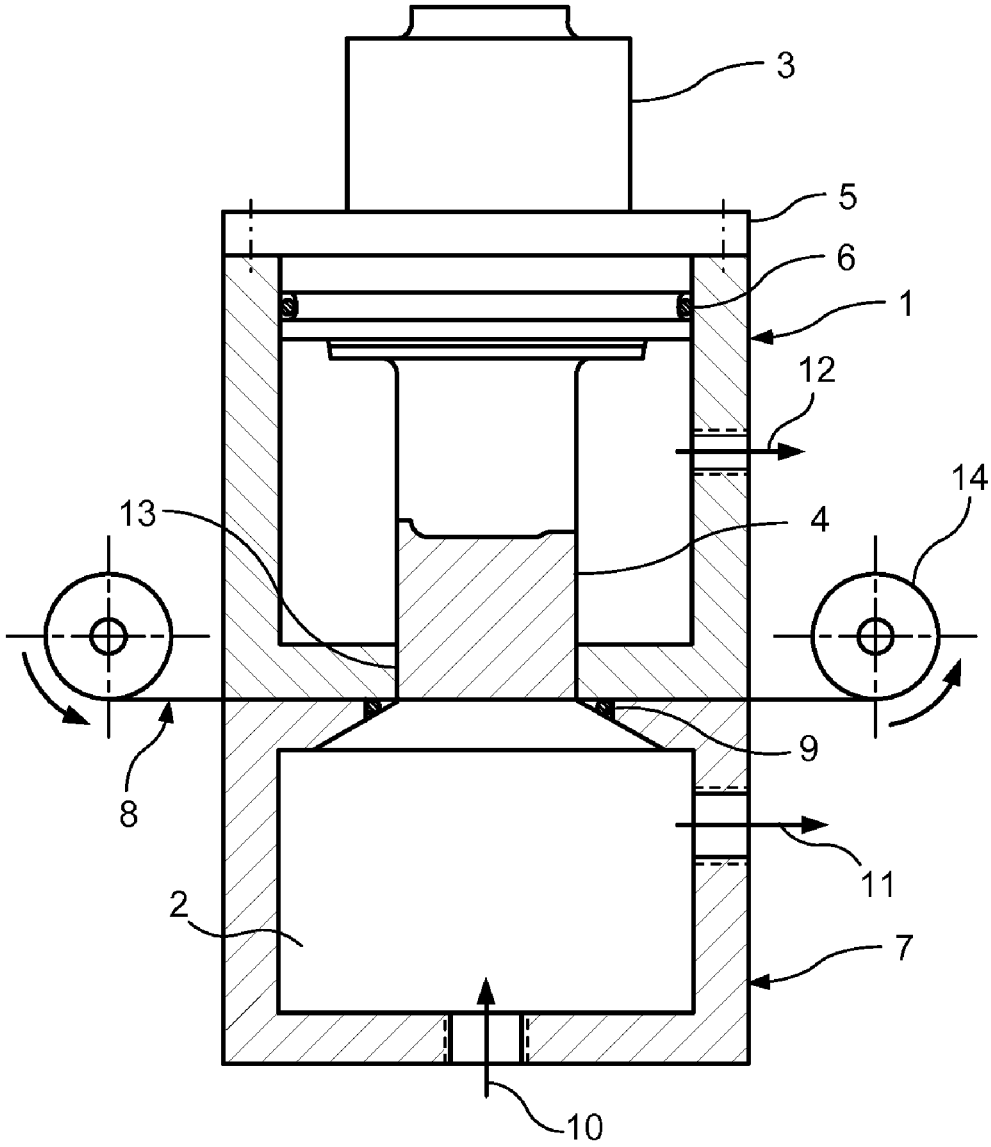

| | | | | | |
|---|---|---|---|---|---|
| 3,672,823 | A | * | 6/1972 | Boucher | 422/20 |
| 3,688,527 | A | * | 9/1972 | Blustain | 68/3 SS |
| 4,044,174 | A | * | 8/1977 | Carr | 427/130 |
| 4,071,225 | A | * | 1/1978 | Holl | 366/114 |
| 4,157,420 | A | * | 6/1979 | Bourrain et al. | 428/392 |
| 4,302,485 | A | * | 11/1981 | Last et al. | 427/601 |
| 4,310,906 | A | * | 1/1982 | Cantrell et al. | 367/181 |
| 4,360,955 | A | * | 11/1982 | Block | 29/25.42 |
| 4,483,571 | A | * | 11/1984 | Mishiro | 310/323.19 |
| 4,558,249 | A | * | 12/1985 | Lerch et al. | 310/322 |
| 4,779,563 | A | * | 10/1988 | Ishikawa et al. | 118/612 |
| 5,010,369 | A | * | 4/1991 | Nowak et al. | 399/319 |
| 5,171,387 | A | * | 12/1992 | Wuchinich | 156/73.3 |
| 5,262,193 | A | * | 11/1993 | Louks et al. | 427/8 |
| 5,269,981 | A | * | 12/1993 | Jameson et al. | 264/444 |
| 5,314,737 | A | * | 5/1994 | Cohen et al. | 428/156 |
| 5,370,830 | A | * | 12/1994 | Jameson et al. | 264/442 |
| 5,376,402 | A | * | 12/1994 | Louks et al. | 427/8 |
| 5,459,699 | A | * | 10/1995 | Walter | 367/142 |
| 5,466,401 | A | * | 11/1995 | Cohen et al. | 264/443 |
| 5,889,209 | A | * | 3/1999 | Piedrahita et al. | 73/570 |
| 6,266,836 | B1 | * | 7/2001 | Gallego Juarez et al. | 8/151 |
| 6,481,493 | B1 | * | 11/2002 | Hielscher | 165/169 |
| 6,616,730 | B1 | | 9/2003 | Bienvenu | |
| 6,673,178 | B2 | * | 1/2004 | Ellner et al. | 156/73.1 |
| 6,877,975 | B2 | * | 4/2005 | Wuchinich | 425/174.2 |
| 6,942,904 | B2 | * | 9/2005 | Dahlberg | 427/560 |
| 6,951,616 | B2 | * | 10/2005 | Dahlberg | 210/748 |
| 7,261,823 | B2 | * | 8/2007 | Dahlberg et al. | 210/783 |
| 7,311,679 | B2 | * | 12/2007 | Desilets et al. | 601/3 |
| 7,568,251 | B2 | * | 8/2009 | Janssen et al. | 8/159 |
| 2002/0068872 | A1 | | 6/2002 | Manna et al. | |
| 2002/0074380 | A1 | * | 6/2002 | Ellner et al. | 228/110.1 |
| 2002/0090047 | A1 | * | 7/2002 | Stringham | 376/100 |
| 2002/0153264 | A1 | * | 10/2002 | Yamada | 205/724 |
| 2002/0166617 | A1 | * | 11/2002 | Molander et al. | 156/73.1 |
| 2003/0101532 | A1 | * | 6/2003 | Desinger et al. | 15/321 |
| 2004/0058075 | A1 | * | 3/2004 | Dahlberg | 427/355 |
| 2004/0104179 | A1 | * | 6/2004 | Nilsson et al. | 210/748 |
| 2004/0154994 | A1 | * | 8/2004 | Dahlberg | 210/748 |
| 2005/0000914 | A1 | * | 1/2005 | Dahlberg et al. | 210/748 |
| 2005/0154313 | A1 | * | 7/2005 | Desilets et al. | 600/459 |
| 2008/0155762 | A1 | * | 7/2008 | Janssen et al. | 8/444 |
| 2008/0210256 | A1 | * | 9/2008 | Kretschmer et al. | 134/1 |
| 2008/0251375 | A1 | * | 10/2008 | Hielscher et al. | 204/157.42 |
| 2009/0079300 | A1 | * | 3/2009 | Hielscher et al. | 310/324 |

FOREIGN PATENT DOCUMENTS

| | | | | |
|---|---|---|---|---|
| DE | 40 41 365 | A1 | | 7/1992 |
| DE | 4233318 | A1 | * | 3/1994 |
| DE | 19541129 | C1 | * | 2/1997 |
| DE | 19801832 | A1 | * | 7/1999 |
| DE | 19828914 | A1 | * | 12/1999 |
| DE | 102 43 837 | A1 | | 3/2004 |
| FR | 2 279 449 | A | | 2/1976 |
| GB | 2250930 | A | * | 6/1992 |
| GB | 2250931 | A | * | 6/1992 |
| WO | 94 04265 | A | | 3/1994 |
| WO | WO 96/28599 | | * | 9/1996 |
| WO | WO 9749499 | A1 | * | 12/1997 |
| WO | WO 9834738 | A1 | * | 8/1998 |
| WO | WO 03/053856 | A1 | * | 7/2003 |

* cited by examiner

DEVICE FOR INTRODUCING ULTRASOUND INTO A FLOWABLE MEDIUM

The invention is directed to a method and a device for introducing ultrasound into a flowable medium using a sonotrode, wherein the flowable medium is not in direct contact with the sonotrode.

When corresponding energy is introduced into a flowable medium, the region exposed to ultrasound causes cavitation accompanied by locally concentrated, extremely high pressures and temperatures, which causes fine particles to become detached from the material of the sonotrode, if the sonotrode directly contacts the treated medium. Most conventional sonotrodes have metallic surfaces, enabling very fine particles and metal ions to enter the material to be treated, which is highly undesirable for many materials treated with ultrasound, such as food or drugs. Disadvantageous is also the wear of the sonotrode material, because wear increases the surface roughness and subsequently causes formation of micro-tears in the sonotrode, so that the sonotrode must be replaced more or less frequently. In DE 102 43 837 A1, it is proposed to transmit the ultrasound to a medium by placing another liquid in between, so that the flowable medium does not come into direct contact with the sonotrode, whereby the liquid is under overpressure and separated from the medium to be treated by a wall. To this end, the transfer liquid must be held in a pressurized vessel, with the sonotrode attached to the wall of the vessel. In this way, particles that are dislodged from the sonotrode cannot enter the medium to be treated. However, cavitation still takes place in the liquid and causes wear of the oscillating walls of the flow cell and the sonotrode.

In DE 40 41 365 A1 it was proposed to reduce wear caused by cavitation by applying to the oscillating end of the sonotrode a protective coating made of polycrystalline diamond. However, this measure significantly increases in the cost of the sonotrode.

It is therefore an object of the invention to provide a method and a device of the aforedescribed type for reducing the self-induced wear on the sonotrode in a significant and cost-effective way.

Accordingly, the following process steps are carried out:

Applying a foil to the sonotrode such that the pressing force by which the foil is pressed against the sonotrode is always large enough so as to enable the foil to follow the stroke motion of the sonotrode at the corresponding frequency and amplitude.

Introducing the ultrasonic energy via the foil into the medium and transferring the wear phenomena to the foil.

In a preferred variant of the method, the pressing force applied to the foil by generating a reduced pressure on the side facing the sonotrode compared to the pressure on the side of the foil facing away from the sonotrode, or for a curved sonotrode, where the foil is disposed over the outside of the sonotrode, by generating a tensile force on the foil.

According to a preferred variant of the method, the foil is wetted with a liquid on the side facing the sonotrode, for example, with an oil, an artificial resin, or a silicone compound.

Advantageously, the foil is moved continuously or discontinuously over the sonotrode.

With this method, the wear phenomena are advantageously transferred from the sonotrode to the foil. The method can be used in the food processing industry, in the pharmaceutical and chemical industry, for mixing or emulsifying different liquids, for treating sewage sludge, and in other areas where ultrasound is employed. When using aggressive media, an additional advantage is obtained in that the foil protects of the sonotrode also from a chemical reaction.

A device suitable for carrying out the method is advantageously constructed so that a flexible foil is arranged between the sonotrode and the medium, such that the foil directly contacts the sonotrode or is located indirectly above of the sonotrode with a gap of up to 100 μm, that during the operation of the device the pressing force exerted by the foil on the sonotrode is supported by tensile forces and that the pressing force is kept large enough during the operation of the device so that the foil always directly or indirectly contacts the sonotrode and follows the stroke motion. Liquid substances can be disposed in the gap up to 100 μm.

The pressing force can be easily realized by maintaining in the medium to be treated by ultrasound a suitable static or dynamic pressure, so that the foil is constantly pressed against the sonotrode even when the sonotrode oscillates. In addition, the pressing force can be supported by additional measures, for example, by applying a reduced pressure on the side of the foil facing the sonotrode or, for curved sonotrodes, by tensioning the foil across the sonotrode by a tensioning device, i.e., a tensile force is applied to the foil.

According to a preferred embodiment of the invention, the device can be constructed so that the foil is tensioned between an assembly that holds the sonotrode and a flow cell.

The device can also be constructed so that the foil is tensioned over a plate-shaped sonotrode which is immersed in an open vessel containing the fluid to be exposed to ultrasonic energy.

According to another variant, the device can also be constructed as an ultrasonic tank, with the piezo-oscillator mounted on the outside of the tank. The foil is then placed on the inside wall of the ultrasonic tank and is pressed against the oscillating surface by a reduced pressure.

For advancing the foil, the device is advantageously equipped with a transport arrangement, by which the foil is advanced continuously or in sections between a supply roll and a receiving roll.

The foil can be made of metal or plastic and can have a thickness of between 5 and 200 μm. To ensure close contact between the foil and the sonotrode, the foil can in addition be wetted on the side facing the sonotrode with a liquid, an oil, an artificial resin, or silicone.

Figure 2:
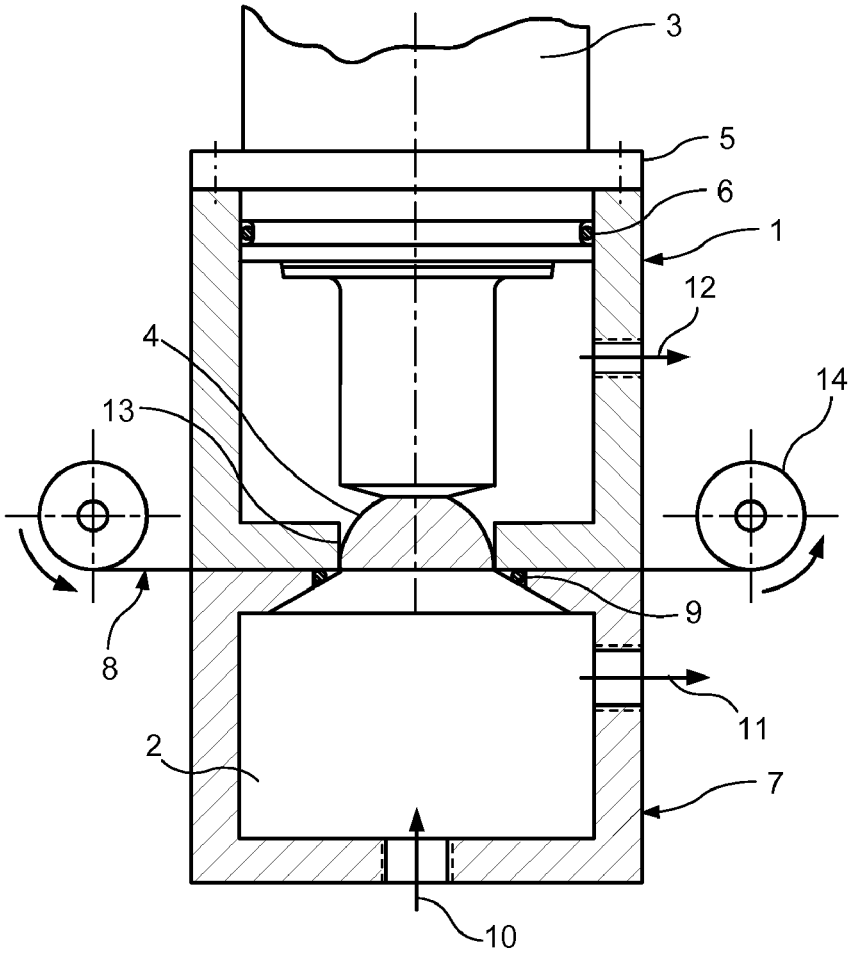
Figure 3:
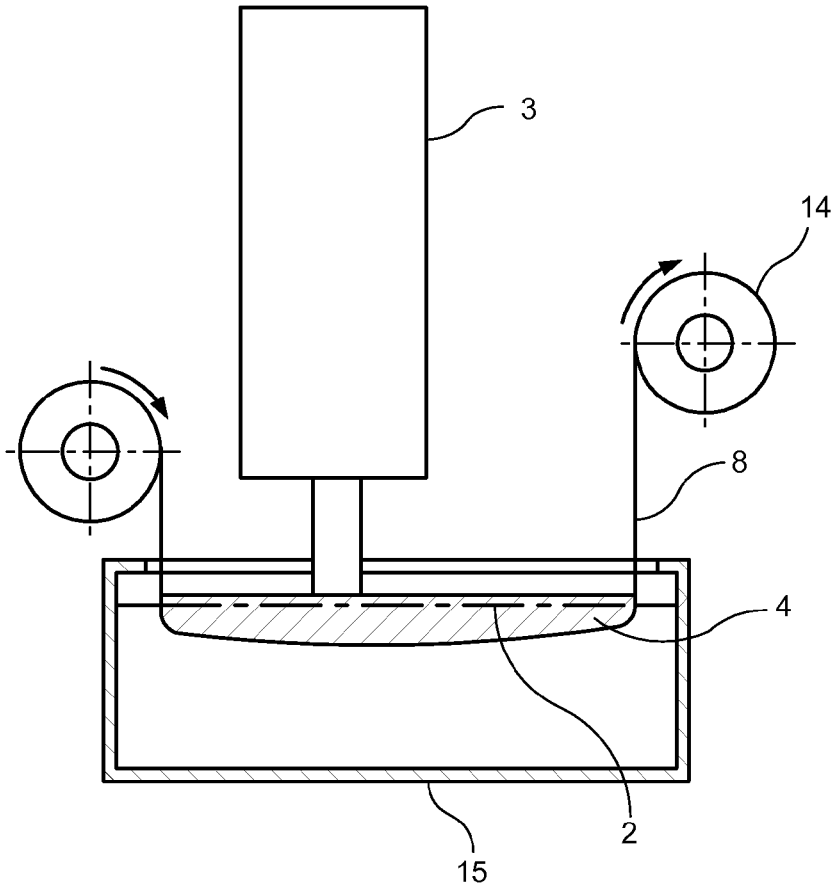
Figure 4:
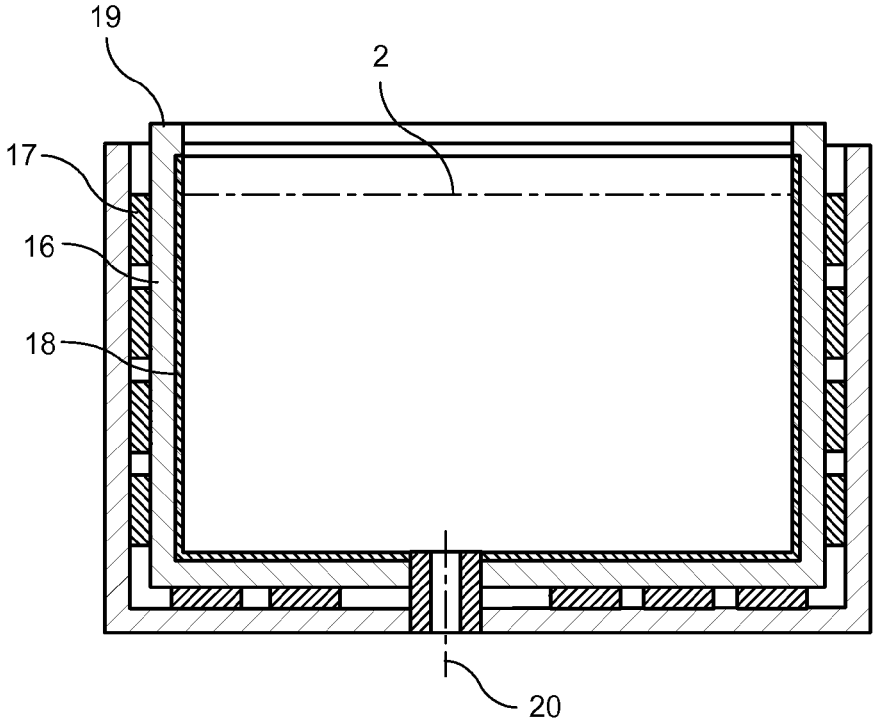
Figure 5:
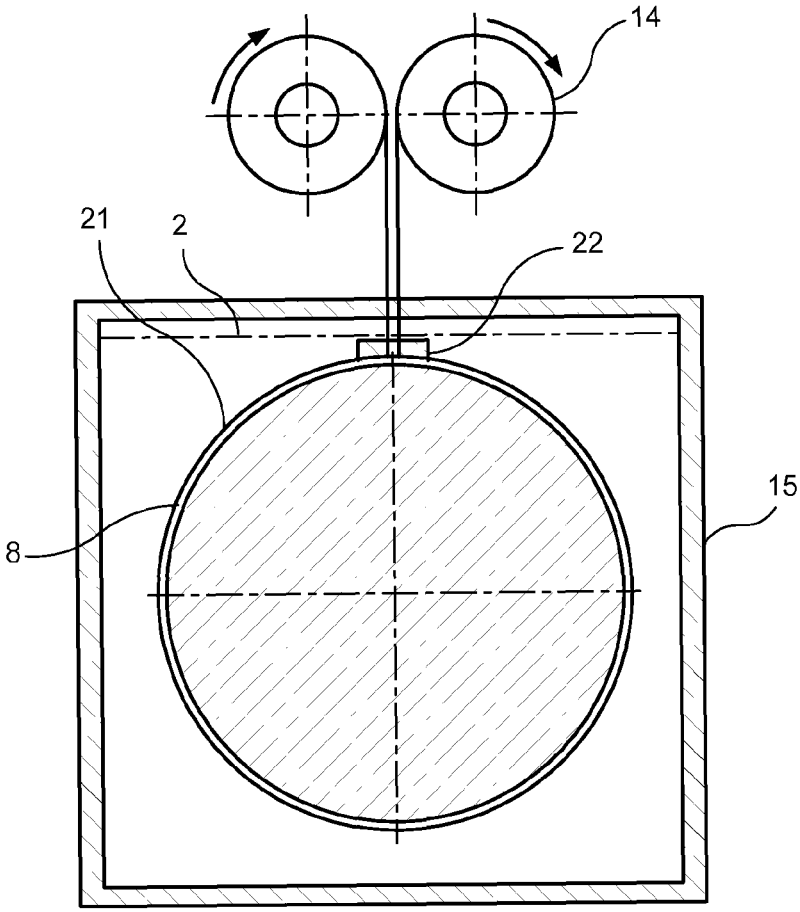

The invention will now be described in more detail with reference to exemplary embodiments. The arrangements depicted in the corresponding drawings show in FIG. 1 schematically, a device according to the invention with a block sonotrode, FIG. 2 schematically, a device of this type with a bending oscillator as a sonotrode, FIG. 3 schematically, a device according to the invention with a plate oscillator as a sonotrode, FIG. 4 schematically, an ultrasound tank with the foil according to the invention, and FIG. 5 schematically, the invention implemented as a waveguide oscillator sonotrode.

FIG. 1 shows a device 1 for ultrasonic treatment of a flowable medium 2. An ultrasonic transducer 3 with a sonotrode 4, implemented here as a block sonotrode, is fixedly connected with the device 1 via a flange connection 5 and is in addition sealed against the interior space of the device 1 by a seal 6. The bottom side of the device 1 is connected with a flow cell 7, whereby a thin foil 8 having a thickness preferably in a range from 5 μm-200 μm, for example 50 μm, is placed between the device 1 and the flow cell 7, so that the foil 8 directly contacts the end face of the sonotrode 4 and seals by way of a seal 9 the space inside the device 1 against the flow cell 7 and the flow cell 7 against the outside.

A medium 2 (preferably a liquid, e.g., water) to be exposed to the ultrasound is pumped through the flow cell 7 through an inlet and an outlet 10, 11. The foil 8 is pressed against the end face of the sonotrode 4 by the increasing pressure in the flow cell 7. In addition, a reduced pressure is generated in the device 1 via a connection 12, which additionally pulls the foil 8 towards the end face of the sonotrode 4 across a small gap 13 of, e.g. 0.1 mm, that remains between the sonotrode 4 and the housing of the device 1. The force produced by the reduced pressure must be greater than the acceleration forces acting on the foil 8 at the end face of the sonotrode 4, so as to always maintain contact between the foil 8 and the sonotrode 4. This process can be aided by applying a tear-resistant liquid or a liquid film on the side of the foil facing away from the medium 2.

During operation of the device 1, a cavitation field is generated in the flow cell 7 by the sonotrode 4 and the foil 8. The wear caused by the cavitation is then exclusively directed to the foil 8. Depending on the magnitude of the produced mechanical amplitude, here for example 100 μm, and the properties of the foil 8, a useful service life of the foil 8 of several minutes is achieved. A transport arrangement 14 for the foil 8 ensures that the exposure time of the foil to the ultrasound is always less than the useful service life.

FIG. 2 shows a variant of the device 1 with the sonotrode 4 implemented as a bending oscillator.

FIG. 3 shows an ultrasonic treatment system with an open treatment vessel 15. An ultrasonic transducer 3 introduces oscillations in a sonotrode 4. The oscillations are transmitted into a liquid medium 2 via the end face of the sonotrode 4.

In order to eliminate wear at the end face of the sonotrode 4 produced by cavitation, a thin foil 8 is introduced by a transport arrangement 14 so that the medium 2 does not contact the end face of the sonotrode 4. The foil 8 has preferably a thickness of 5 μm-200 μm, here for example 50 μm. The tensile force applied by the transport arrangement 14 must be large enough so that the foil 8 is permanently pressed against the end face of the sonotrode 4. During operation, this pressing force must be always greater than the acceleration force applied to the foil 8 by the oscillating sonotrode 4.

FIG. 4 shows the invention in conjunction with an ultrasonic tank. The construction of an ultrasonic tank is generally known and has been sufficiently described.

The device consists of the actual tank 16 and the piezo-oscillator 17 attached on the outside of the tank 16 and operating as a sonotrode. To suppress the wear phenomena caused by cavitation, a thin foil 18 is introduced inside the tank 16. The foil 18 has preferably a thickness of 5 μm-200 μm, here for example 50 μm.

The foil 18 is held in place by a cover 19 which simultaneously seals the space between the foil 18 and the tank 16. The foil 18 is pulled against the tank 16 by applying a reduced pressure via a connection 20.

FIG. 5 shows the invention in conjunction with a waveguide oscillator, again disposed inside an open treatment vessel 15. Oscillations are excited on the exterior surface of an ultrasonic transducer 21 implemented as a waveguide oscillator. The oscillations are transmitted via the exterior surface to the liquid 2.

In order to eliminate wear on the exterior surface of the ultrasonic transducer 21 caused by cavitation, a thin foil 8 is introduced via a transport arrangement 14 so that no liquid 2 contacts the exterior surface of the ultrasonic transducer 21. The foil 8 has preferably a thickness of 5 μm-200 μm, here for example 50 μm. The foil 8 is placed around the ultrasonic transducer 21 by a device 22 capable of applying a pressing force to the foil 8, so that no liquid 2 is able to contact the exterior surface of the ultrasonic transducer 21, not even at the deflection points. The tensile force exerted by the transport arrangement 14 must be large enough so as to permanently press the foil 8 is against the exterior surface of the ultrasonic transducer 21. During operation, this pressing force must be always greater than the acceleration force that is exerted on the foil 8 by the oscillating exterior surface of the ultrasonic transducer 21.

LIST OF REFERENCE NUMERALS

1 device (for receiving the sonotrode)
2 flowable medium
3 ultrasonic transducer
4 sonotrode
5 flange connection
6 seal
7 flow cell
8 foil
9 seal
10 inlet (of the medium to be treated by ultrasound)
11 outlet (of the medium to be treated by ultrasound)
12 connection for generating a reduced pressure
13 gap
14 transport arrangement
15 treatment vessel
16 tank
17 piezo-oscillator
18 foil
19 cover
20 connection for generating a reduced pressure
21 ultrasonic transducer
22 device (for applying a pressing force to the foil)

The invention claimed is:

1. Device for introducing ultrasound into a flowable medium via a sonotrode, comprising a sonotrode, a flow cell for containing a flowable medium, a foil arranged between the sonotrode and the flow cell in such a way that, in a non-operating state, the foil is located spaced apart from the sonotrode with a gap of up to 100 μm, the foil being arranged so as to prevent contact between the sonotrode and a flowable medium in the flow cell, a seal located between a second side of the foil facing away from the sonotrode and the flow cell, which seals the flow cell within the device, a tensile means for exerting a pressing force against the sonotrode by way of the foil, such that during operation of the device, the pressing force is maintained sufficiently large so that the foil contacts the sonotrode and follows the stroke motion thereof to thereby transfer ultrasound to the flowable medium during operation of the device, a means for reducing pressure with respect to a space formed on a first side of the foil facing the sonotrode, a liquid residing within the gap, said liquid contacting the first side of the foil, said liquid being chosen from the group consisting of an oil, an artificial resin and a silicone compound, and a transport means for continuously or discontinuously advancing the foil with respect to the sonotrode during operation of the device.

2. Device according to claim 1, wherein the foil resides against the sonotrode during operation and is held by a tensioning device.

3. Device according to claim 1, further comprising a means for applying an overpressure to the flowable medium during operation of the device.

4. Device according to claim 1, wherein the foil is a metal foil.

5. Device according to claim 1, wherein the foil is a plastic foil.

6. Device according to claim 1, wherein the thickness of the foil is between 5 and 200 μm.

* * * * *